United States Patent [19]

Schumacher et al.

[11] 4,077,228

[45] Mar. 7, 1978

[54] REFRIGERATED DISPLAY CASE

[75] Inventors: Neal P. Schumacher, Trenton, N.J.; Shyamol K. Ghosh, Barrie, Canada

[73] Assignee: Emhart Industries, Inc., Farmington, Conn.

[21] Appl. No.: 714,722

[22] Filed: Aug. 16, 1976

[51] Int. Cl.[2] ..... A47F 3/04; F25D 15/00; F24F 13/00; F24F 9/00

[52] U.S. Cl. ..... 62/256; 62/237; 98/33 R; 98/36

[58] Field of Search ..... 62/256, 237, 255, 257, 62/253, 458, 259, 260, 246, 249; 98/33 R, 36; 165/53, 56

[56] References Cited

U.S. PATENT DOCUMENTS

| | | | |
|---|---|---|---|
| 2,209,263 | 7/1940 | Gaines | 98/33 R |
| 2,281,002 | 4/1942 | Eck | 98/33 R |
| 2,855,762 | 10/1958 | Zehnder | 98/36 |
| 3,018,712 | 1/1962 | Wacker | 98/36 |
| 3,049,984 | 8/1962 | Boysen | 98/36 |
| 3,068,775 | 12/1962 | Zehnder | 98/36 |
| 3,123,988 | 3/1964 | Richman | 62/256 |
| 3,301,162 | 1/1967 | Zumbiel | 98/36 |
| 3,392,543 | 7/1968 | Miller | 62/256 |
| 3,478,535 | 11/1969 | Perez et al. | 62/237 |
| 3,507,322 | 4/1970 | Tetrick et al. | 62/237 |
| 3,690,118 | 9/1972 | Rainwater | 62/256 |
| 3,698,205 | 10/1972 | Perez | 62/256 |
| 3,698,205 | 10/1972 | Perez | 62/256 |
| 4,023,378 | 5/1977 | Kennedy et al. | 62/256 |

*Primary Examiner*—Lloyd L. King
*Attorney, Agent, or Firm*—Frederick A. Zoda

[57] ABSTRACT

A refrigerated display case of the type having an open-front air curtain design to allow direct access by shoppers to the goods displayed within the refrigerated environment therein, including a stationary display fixture which defines a refrigerated enclosure therein and which presents an open-front section having at least one air curtain extending thereover, the display case including upper outlets and lower inlets adjacent the single or multiple air curtains extending over the open-front section, further including at least one movable display cart adapted to transport goods into the interior of the display case and adapted to remain in this location upon the floor of the case for display of the goods thereon, the fixture including a lower air return duct extending from the front edge of the fixture below the case floor to the rear section of the case to provide a flat case floor at approximately the same level as the surrounding store floor to facilitate movement of the display carts into and out of the stationary display fixture.

5 Claims, 5 Drawing Figures

REFRIGERATED DISPLAY CASE

BACKGROUND OF THE INVENTION

1. Field Of The Invention

The present invention generally relates to open-front type refrigerated display cases configured such as to facilitate the movement of loaded mobile carts from a storage location to a display location within a stationary display fixture of the refrigerated case.

When utilizing refrigerated display cases for holding certain types of goods, it is desirable to minimize handling. In particular, when displaying bulk materials such as dairy products or other liquids, it becomes quite a tedious operation to transfer the goods from a storage location to a transfer cart and then from a transfer cart into the stationary display case. These two steps can be combined into one step by providing a movable display cart as a part of a refrigerated display case in which the cart may freely be moved to a stationary location within the display fixture to allow customers to take the desired items directly from the movable display cart from its fixed position within the refrigerated environment.

2. Description Of The Prior Art

U.S. Pat. No. 3,478,535 issued to A. Perez et al. is an example of a refrigerated display case utilizing movable carts for fixed display therein. This system was one of the early attempts to provide a savings in the time and effort of stocking of dairy handling cases. However, the front section of the case designated as 13 had to be made removable and, as such, much of the time saved was lost in the removal operation of the lower front section. Also the lower return ducts designated as 18 and 19 are obstructions to placement of the loaded carts within the case and therefore the efficiency of the prior art systems was only slightly exceeded.

U.S. Pat. No. 3,392,543 to Miller shows another refrigerated case design utilizing removable carts for transporting and displaying bulk materials. This design required careful and time consuming orientation of the case with respect to the receiving tracks 43. Also this case required a complicated structure built into the lower section of the cart base for providing a return flow duct for the air at the bottom edge of the single or multiple air curtains. A similar design is shown in U.S. Pat. No. 3,690,118 which utilizes the movable cart to provide the upper wall for the return duct. This return duct is formed by the cart when positioned within the case. The walls of the duct are formed by the underside of the cart in cooperation with the walls and floor of the refrigerated enclosure. In the '118 patent and the '543 patent, no closed cycle air curtain system is disclosed for retaining the refrigerated air curtain when the carts are not in place within the cases.

The present design provides a dairy handling refrigerated display case utilizing movable display carts without any types of orientation tracks, above ground ducts, ducts within the cart structure or removable sections of the stationary display fixtures. The present design is novel in these respects and presents a simple and efficient system for displaying bulky goods within refrigerated display cases.

SUMMARY OF THE INVENTION

The present invention discloses apparatus for displaying articles within a stationary display fixture. The stationary display fixture is adapted to receive movable display carts therein. When customers have removed all the items from the movable display cart, it may be removed from the stationary display fixture and reloaded in the stock room.

The present refrigerated display case also includes an open front section having single or multiple air curtains flowing thereover. The air curtains are formed by the flow of refrigerated air from outlets along the upper end of the open-front section such that the refrigerated air flows downwardly in a curtain configuration to be received by the air inlets along the lower edge of the open front section. This air curtain design maintains the refrigerated environment within the display case while still allowing unimpeded direct access by the customer to the goods within the refrigerated environment.

To facilitate movement of the movable display carts into and out of the stationary display fixture the lower air return duct which returns air from the lower end of the air curtain to the rear of the display case is located below the flat case floor. In this manner there will be no ducts, tracks, or other structures on the case floor to inhibit movement of the carts into and out of the stationary fixture.

The inlet into the lower air return duct may take the form of a grating which is flush with the floor of the case and extending across the front edge thereof. Preferably the grating and the case floor are at approximately the same level as the surrounding floor of the store to further facilitate movement of the movable display carts. The grating will allow the air to travel from the lower end of the air curtain into the lower return duct below the case floor and therefore move toward the rear of the stationary fixture. This air may then be moved upwardly to be refrigerated and returned to the upper air curtain outlet.

Alternatively the path means adjacent the case floor may be provided in the rear section of the stationary display fixture. In this embodiment the refrigerated display case may be described as a rear-entrance case rather than a front-entrance case as above described. To facilitate movement of the cart into the case from the back, a plurality of doors may form the rear walls of the display fixture. In this manner when the doors are opened the movable display carts can be moved directly into the stationary position within the fixture. Also with this configuration an upwardly extending lower front panel can be positioned above the inlet into the air return duct which is below the floor of the case. This panel will be fixed in position and will not be removable. The panel will include an air inlet extending along the lower end of the open front section to provide fluid flow communication for the air at the bottom of the air curtain into the lower return duct and to the back of the refrigerated case. Fluid flow communication upward for refrigeration of the air and supply of the air to the refrigerated air supply means is provided by vertical conduits.

In another embodiment of the present invention the display case may be positioned between a customer aisle and a refrigerated store room or the like such that the air traveling toward the rear of the case in the air return duct will return to the refrigerated environment of the refrigerated room. Similarly the supply of refrigerated air to the upper air curtain outlets will be provided directly by the flow of air from the refrigerated environment to the refrigerated air supply means or upper outlets.

It is an object of the present invention to provide a refrigerated display case which facilitates quick and easy movement of the movable display carts into and out of the stationary display fixtures.

It is an object of the present invention to provide a refrigerated display case having a flat case floor.

It is an object of the present invention to provide a refrigerated display case in which the air return duct is located below the relatively flat case floor.

It is an object of the present invention to provide a refrigerated display fixture including a plurality of movable display carts locatable within a stationary refrigerated enclosure until the goods or items thereon are completely removed by customers.

It is an object of the present invention to provide a refrigerated display case in which a full air flow pattern is provided for a single or multiple air curtain design at all times whether or not the movable display carts are located within the refrigerated environment.

It is an object of the present invention to provide a refrigerated display case having a full circuit of air flow without the carts being positioned within the fixture.

It is an object of the present invention to provide a simple and efficient system for displaying bulk dairy and other goods within refrigerated environments.

It is an object of the present invention to provide a refrigerated display case having a relatively flat case floor and a relatively flat air curtain inlet grating at the same level as the surrounding store floor.

It is an object of the present invention to provide a refrigerated display case in which the relatively flat case floor is at the same level as the surrounding store floor.

It is an object of the present invention to provide a stationary display fixture having a fixed lower front panel as well as rear doors operable to open to allow movement of movable display carts into a position within the refrigerated stationary fixture.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
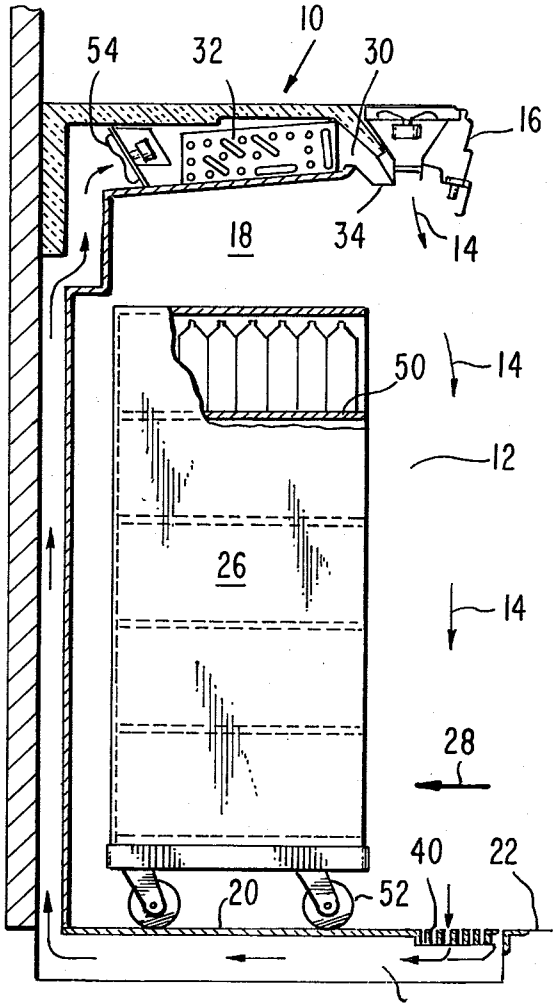
FIG. 2 is a transverse sectional view of the embodiment depicted in FIG. 1, a display cart being shown in side elevation with a portion of one side wall thereof broken away.

The present invention provides a refrigerated display case 10 of the type having an open-front design to allow direct access to the goods therein by store customers. To maintain refrigeration within the display case, a single or multiple air curtain circuit is established across the front access opening. The refrigerated display case includes a stationary display fixture 16 which defines the refrigerated enclosure 18 therein in which the goods 24 are located upon a movable display cart 26.

The air curtain 14 flows downwardly across the open front 12 of the display case, from air outlets 34 to air inlets 38. With a single inlet and outlet a single air curtain will be maintained, however with multiple inlets and outlets multiple curtains will be created for greater refrigerant and better insulation from the ambient environment.

Within the stationary display fixture 16 is a case floor 20 in the form of a flat plate below which is located a lower air return duct 36 the top wall of which is defined by the plate, and which carries air from the bottom of the air curtain 14 to the rear section of the display fixture 16. Preferably the case floor 20 is at the same level as the store floor 22 to facilitate the movement of the cart 26 into place within the stationary display fixture 16 when loaded and to withdraw the cart 26 from within the fixture once the goods have been removed. The cart 26 can be moved into position upon the case floor 20 within the case 10 from the front in the embodiment shown in FIG. 1 and from the back in the embodiment shown in FIG. 4. In each of these preferred embodiments a path means or cart passage 28 is provided such that the cart can be moved along a level floor line from outside of the case to a stationary resting position upon the case floor 20 within the fixture. The path means 28 is shown by the arrows in FIGS. 2 and 5. In the front loading design shown in FIG. 1, a grating 40 is preferable to operate as the air inlet 38 leading to air return duct 36 in order to provide a surface over which the carts 26 may move when traveling into and out of the display location.

Figure 5:
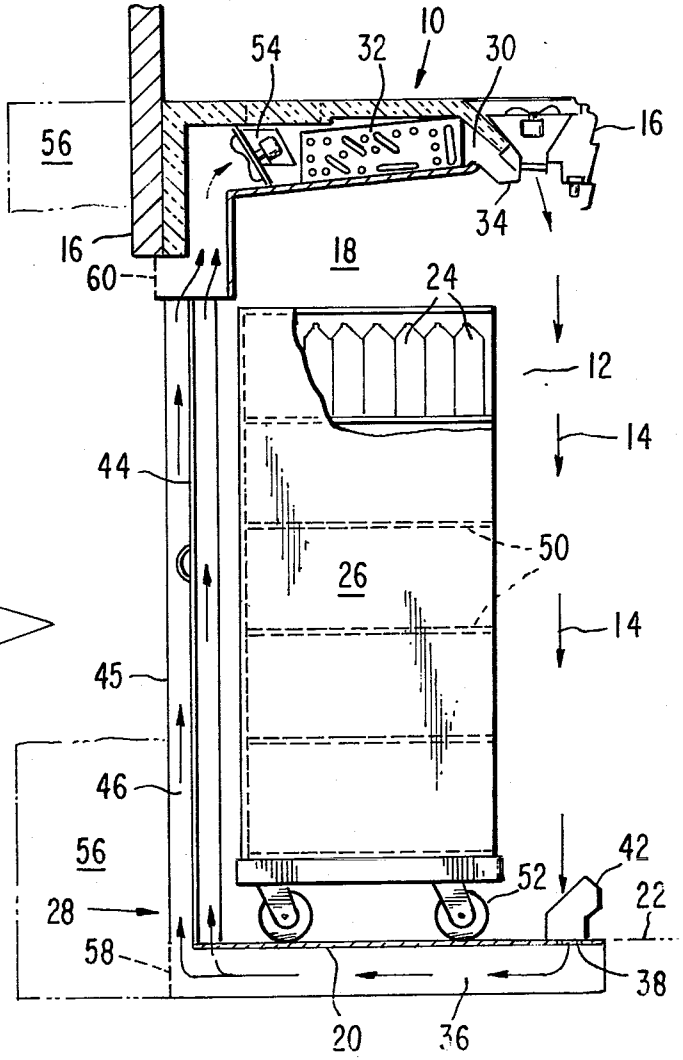
FIG. 5 is a view, similar to FIG. 2, of the embodiment shown in FIG. 4.
Figure 4:
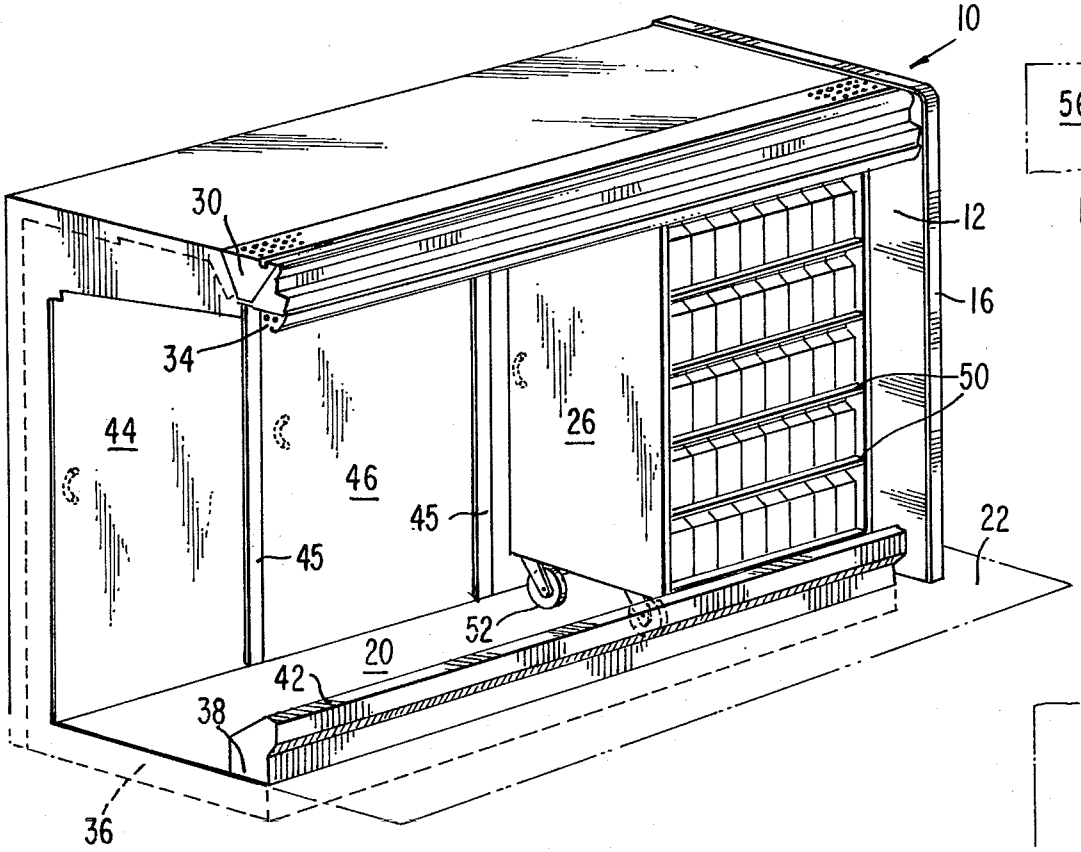
FIG. 4 is a perspective view, similar to FIG. 1, of another embodiment of the present invention.

With the rear loading design shown in FIGS. 4 and 5 a lower case panel 42 may be included affixed securely to the side walls or to the floor in order to channel the air from the curtain to the air inlet 38. This lower case panel is also decorative and aids in insulating the refrigerated environment from the warmer ambient surroundings. With the rear loading structure a plurality of doors 44 may be located along the back wall between vertically extending conduits. The vertical conduits 45 define sides of the cart passages 28, and provide flow paths for the movement upward of air from the air return duct 36 such that this air, which is still cooler than the ambient, may be further refrigerated and passed through the air outlet 34 to merge into the air curtain 14. When opened the doors 44 will provide rear openings 46 through which the movable display carts may be moved between the conduits 45 to a position for display of the goods thereon within the stationary display fixture 16. The carts 26 will include display shelves 50 for holding a maximum volume of goods thereon to minimize case loading requirements. The carts 26 will preferably be movable upon wheels or casters 52.

With the rear loading design the refrigerated display case 10 may be positioned with the rear section thereof in abutment with a refrigerated environment or room 56. In this configuration there is no longer any requirement for vertically extending conduits 45 or any other means to communicate the cool air from the lower air return duct 36 to the refrigerated air supply means 30. In this configuration the air will pass from duct 36 through aperture 58 into the refrigerated room 56. Aperture 58 is shown in FIG. 5 in dotted outline. Refrigerated air will then be supplied through aperture 60 from refrigerated room 56 to the refrigerated supply means 30. With this system there will be no need for any evaporator or cooling means 32 since the air being supplied to the air outlet 34 will already be refrigerated since it is flowing directly from the refrigerated room 56. Only the fan means 54, as normally required with the refrigerated air supply means 30 and cooling means 32, will be utilized to draw air from the refrigerated room 56 to the top of the air curtain 14.

Figure 1:
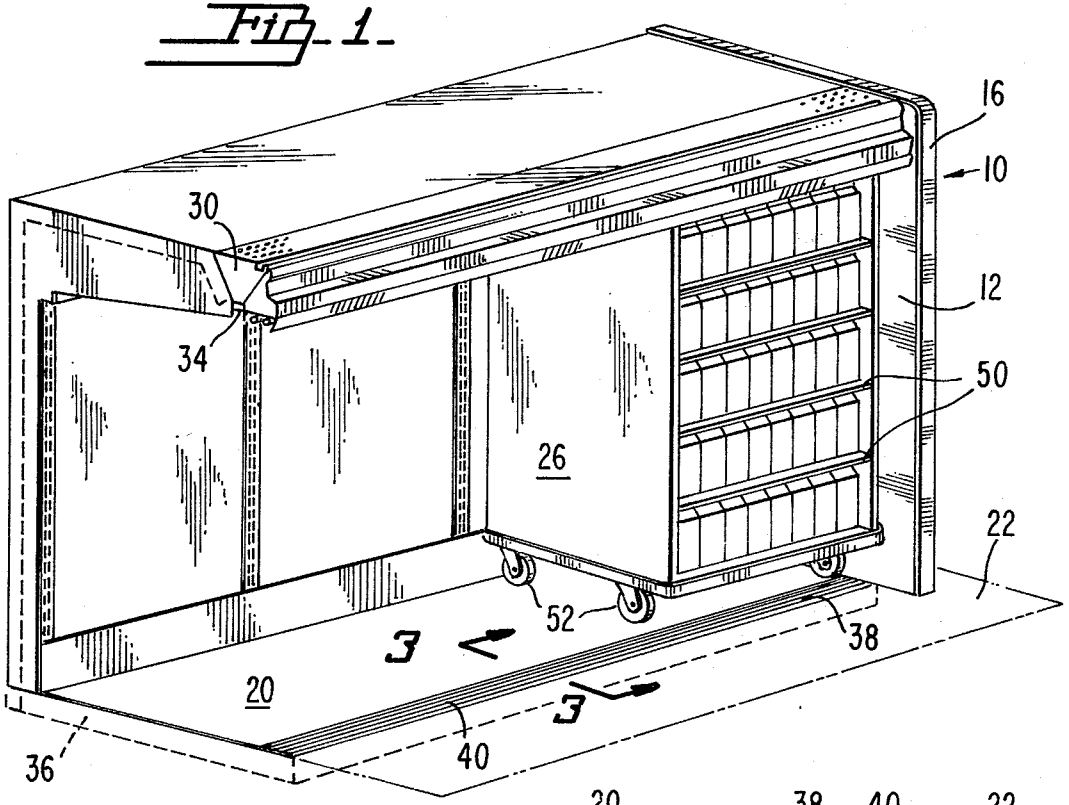
FIG. 1 is a perspective view of the present invention in which the store floor is shown in chain-dotted lines.
Figure 3:
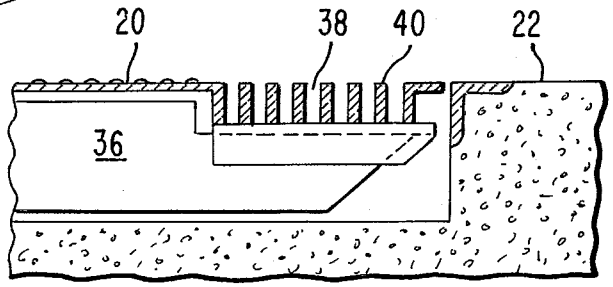
FIG. 3 is an enlarged detail sectional view taken on line 3—3 of FIG. 1.

The present design provides a refrigerated display case which is capable of being loaded quickly and easily. The carts 26 may be located in a stock room and moved to the desired display case. At this location the cart may be moved directly into the fixture 16 upon case floor 20 without requiring the removal of the goods therefrom for placement within shelves or similar supports which are fixedly located within prior art refrigerated display cases. One of the primary advantages of the present system is the completely flat case floor 20 and grating 40 as shown in FIG. 1 at the same level as the surrounding store floor 22. In the front load design there is no ducting or other configurations above the floor level as shown in the prior art designs which would require the workers to perform the time consuming task of carefully orienting the cart with respect to the case. In the present configuration the cart may be moved directly into the case in one movement. This design of a completely flat case floor 20 is achieved by the placement of the lower air return duct 36 below the level of the store floor 22 under case floor 20. Grating 40 provides the continuously level path while at the same time providing the air inlet 38 which is in fluid flow communication with lower air return duct 36. It should be appreciated that the design of the present invention is especially adaptable for use with high bulk materials such as milk and other fluids and/or dairy products where loading onto fixed shelving within a refrigerated case is a slow process.

The rear loading design shown in FIGS. 4 and 5 achieves similar desired advantages with the additional requirements of opening rear door means 44 to provide rear openings 46 through which the fully loaded carts 26 may be moved into position upon case floor 20 within fixture 16. With this configuration it is desirable to include the lower case panel 42 to effectively provide a flow path from the air curtain 14 to the duct 36. This panel 42 will be fixedly secured to the case such that it will not be removable without a general disassembly operation. Another one of the advantages of the present invention is the adaptability of the usage of a conventionally configured upper case section with either the front or rear load designs. This adaptability is important in reducing production costs and maintenance.

The above-disclosed refrigerated display case provides a refrigerated display fixture usable with loaded roll-in carts which has the capability of a front or rear loading capacity and in which the case floor is completely flat without any vertically protruding structures thereon and wherein, further, the case floor is at the same level as the surrounding store floor to allow direct movement of the movable display carts 26 therein. Such a design has not been shown in the prior art and provides inherent advantages over that art.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a refrigerated food product display case of the type that comprises a stationary display fixture having a vertical back wall, an open front through which a customer is permitted unimpeded access to the interior of the case and across which an air curtain extends to isolate the displayed products from a surrounding store area, a rear duct extending downwardly along said back wall, and an upper duct in communication with the rear duct and projecting forwardly from the back wall, said upper duct having a discharge opening at its forward end through which air is discharged at the front of the case to form the air curtain, said case further comprising a product display cart rollable into and out of said fixture, the improvement that comprises:

a. a recessed floor surface formed in and opening upwardly into the store area directly below the fixture and generally coextensive with the fixture from front to back thereof; and b. a base for said fixture in the form of a horizontal plate therein that defines the bottom of the fixture and cooperates with the back wall, upper duct, and the front of the fixture to define the interior of the case, said plate providing a surface upon which the cart is directly supported, the plate covering said recessed floor surface to define therebetween a lower duct bounding and disposed wholly outside the case interior below the surrounding floor area of the store, the plate being level with the floor area of the store surrounding said recessed floor surface, said plate intersecting with the lower extremity of the back wall and said lower and rear ducts extending into communication with each other at the intersection of the base plate and the back wall, one at least of the back wall and the front of the case having a cart passage extending fully to the floor level surrounding the recessed floor surface to define an opening through which the cart may be rolled into and out of the case.

2. In a refrigerated food product display case, the improvement of claim 1 wherein said back wall and base plate intersect forwardly of the rear extremity of the lower duct, the rear duct being disposed at least partially rearwardly of the back wall, whereby said recessed floor surface opens upwardly directly into the rear duct at a location outside of and bounding the interior of the case.

3. In a refrigerated food display case, the improvement of claim 1 wherein the cart passage is at the front of the case and the lower duct has an inlet at the bottom end of the cart passage, in the form of a grating level with the top surface of the plate.

4. In a refrigerated food product display case, the improvement of claim 1 wherein the cart passage is at the back of the case in communication with a refrigerated room area into and out of which the cart is rollable through said passage, said upper and lower ducts having vertically aligned inlet and outlet ends, respectively, opening into said room area at the top and bottom ends, respectively, of the cart passage.

5. In a refrigerated food product display case, the improvement of claim 1 wherein the cart passage is at the back of the case, and at least one door mounted on the back of the case for movement from a normal position closing the cart passage to an open position permitting movement of the cart into and out of the case, said rear duct being mounted at the back of the case adjacent the door at a location defining a side of the cart passage.

* * * * *